US006558180B2

(12) United States Patent
Nishimoto

(10) Patent No.: US 6,558,180 B2
(45) Date of Patent: May 6, 2003

(54) WATERPROOF ELECTRICAL CONNECTOR

(75) Inventor: Naohiro Nishimoto, Hashimoto (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/859,678

(22) Filed: May 18, 2001

(65) Prior Publication Data

US 2002/0173193 A1 Nov. 21, 2002

(51) Int. Cl.[7] ..... H01R 13/52
(52) U.S. Cl. ..... 439/282; 439/271
(58) Field of Search ..... 439/282, 281, 439/271, 349, 680

(56) References Cited

U.S. PATENT DOCUMENTS

| | | | | |
|---|---|---|---|---|
| 3,124,405 A | * | 3/1964 | Massa | 175/93 |
| 3,783,434 A | * | 1/1974 | Ransford, III | 439/281 |
| 4,166,664 A | * | 9/1979 | Herrmann, Jr. | 439/258 |
| 4,498,719 A | * | 2/1985 | Juris et al. | 439/278 |
| H113 H | * | 8/1986 | McNeel | 439/282 |

FOREIGN PATENT DOCUMENTS

| | | |
|---|---|---|
| JP | 2541481 Y2 | 9/1992 |
| JP | 2000-9282 A | 1/2000 |

* cited by examiner

*Primary Examiner*—Lynn Field
*Assistant Examiner*—Phuong K Dinh
(74) *Attorney, Agent, or Firm*—Shinjyu Global IP Counselors, LLP

(57) ABSTRACT

Various electrically controlled devices of a bicycle are electrically coupled together by multi-conductor electrical cords. The ends of the electrical cords have an electrical connector that mates with a corresponding electrical connector provided in one of the electrically controlled devices. Each electrical connector of the electrical cords has an electrical contact housing with electrical contacts, an outer casing molded about the electrical contact housing, and an annular sealing member formed of a resilient and compressible material. The outer casing has an attachment portion fixed to one end of the electrical contact housing and a tubular portion radially spaced from the other end of the electrical contact housing. The annular sealing member is located in an annular space formed between the tubular portion and the electrical contact housing.

19 Claims, 10 Drawing Sheets

WATERPROOF ELECTRICAL CONNECTOR

BACKGROUND OF THE INVENTION

1. Field of the Invention

This invention generally relates to an electrical connector. More specifically, the present invention relates an electrical connector.

2. Background Information

Bicycling is becoming an increasingly more popular form of recreation as well as a means of transportation. Moreover, bicycling has also become a very popular competitive sport for both amateurs and professionals. Whether the bicycle is used for recreation, transportation or competition, the bicycle industry is constantly improving the various components of the bicycle. Specifically, manufacturers of bicycle components have been continually improving performance, reliability and appearance of the various components.

Recently, bicycles have been provided with an electronic drive train for smoother shifting. These electronic drive trains include a rear multi-stage sprocket assembly with a motorized rear derailleur and a front multi-stage sprocket assembly with a motorized front derailleur. These derailleurs are electronically operated by a cycle computer for automatically and/or manually shifting of the derailleurs. The cycle computer is also often coupled to other components that are electrically controlled or operated. For example, some bicycles include electronically controlled suspension assemblies for adjusting the stiffness of the ride depending on a variety of factors.

The cycle computer uses one or more sensors to monitor various operations of the bicycle, such as speed, cadence, riding time and gear position, which are in turn used to electrically control or operate these electronic components. In this type of an arrangement, electrical wires or cords are utilized to transmit the electrical current to and from the various components and sensors. These electrical wires or cords are often connected to the components and/or sensors by electrical connectors. These electrical wires and connectors are often attached to the bicycle frame without regard to the appearance of the bicycle.

Since the bicycle is typically utilized outdoors, the electrical connections of the electrical connectors are exposed to a variety of weather conditions. The electrical connections can often be contaminated so as to degrade performance of the operation of the electrically control component. If the electrical connections get too dirty, the bicycle components and/or sensors may not operate properly. Since the electrical connections are exposed to adverse weather conditions, it is important that the electrical connectors provide a good solid connection so that they can operate even though they may become slightly contaminated.

Additionally, in certain riding conditions such as off-road type riding, the cyclist often encounters obstructions such as bushes or tree limbs. Sometimes, these obstructions can catch the electrical wires or cords and affect performance of the electrical components and/or sensors. Additionally, in some situations, other obstructions such as clothing, bicycle lock cables or tools can catch on the electrical wires or cords. Typically, the electrical connectors of the electrical cords are secured to mating electrical connectors via non-releasable connections such as threads or the like. The problem with such non-releasable electrical connectors is that the electrical cord can get caught on an obstruction, which can result in the rider losing control over the bicycle and serious damage to the electrical cord.

In view of the above, there exists a need for an electrical connector which overcomes the above mentioned problems in the prior art. This invention addresses this need in the prior art as well as other needs, which will become apparent to those skilled in the art from this disclosure.

SUMMARY OF THE INVENTION

One object of the present invention is to provide an electrical connector that is used with a mating electrical connector to provide a rigid connection therebetween as well as a watertight connection therebetween.

Another object of the present invention is to provide an electrical connector with a releasable connection therebetween in case of the electrical cord is accidentally caught on an object during riding in order to avoid serious damage to the cord and prevent the rider from losing control over the bicycle.

Another object of the present invention is to provide a male electrical connector, which is relatively simple and inexpensive to manufacture and assemble.

The foregoing objects can basically be attained by providing an electrical connector that comprises an electrical contact housing, at least one electrical contact, an outer casing and an annular sealing member. The electrical contact housing has a first end and a second end with at least one bore extending between the first and second ends. The electrical contact is retained within the bore of the electrical contact housing. The outer casing includes an attachment portion and a tubular portion. The attachment portion is fixedly coupled to the first end of the electrical contact housing. The tubular portion is radially spaced from the second end of the electrical contact housing to form an annular space between an inner surface of the tubular portion and the second end of the electrical contact housing. The tubular portion of the outer casing has an inwardly extending protrusion with an abutment surface that faces away from the second end of the electrical contact housing. The annular sealing member is formed of a resilient and compressible material that is located in the annular space.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
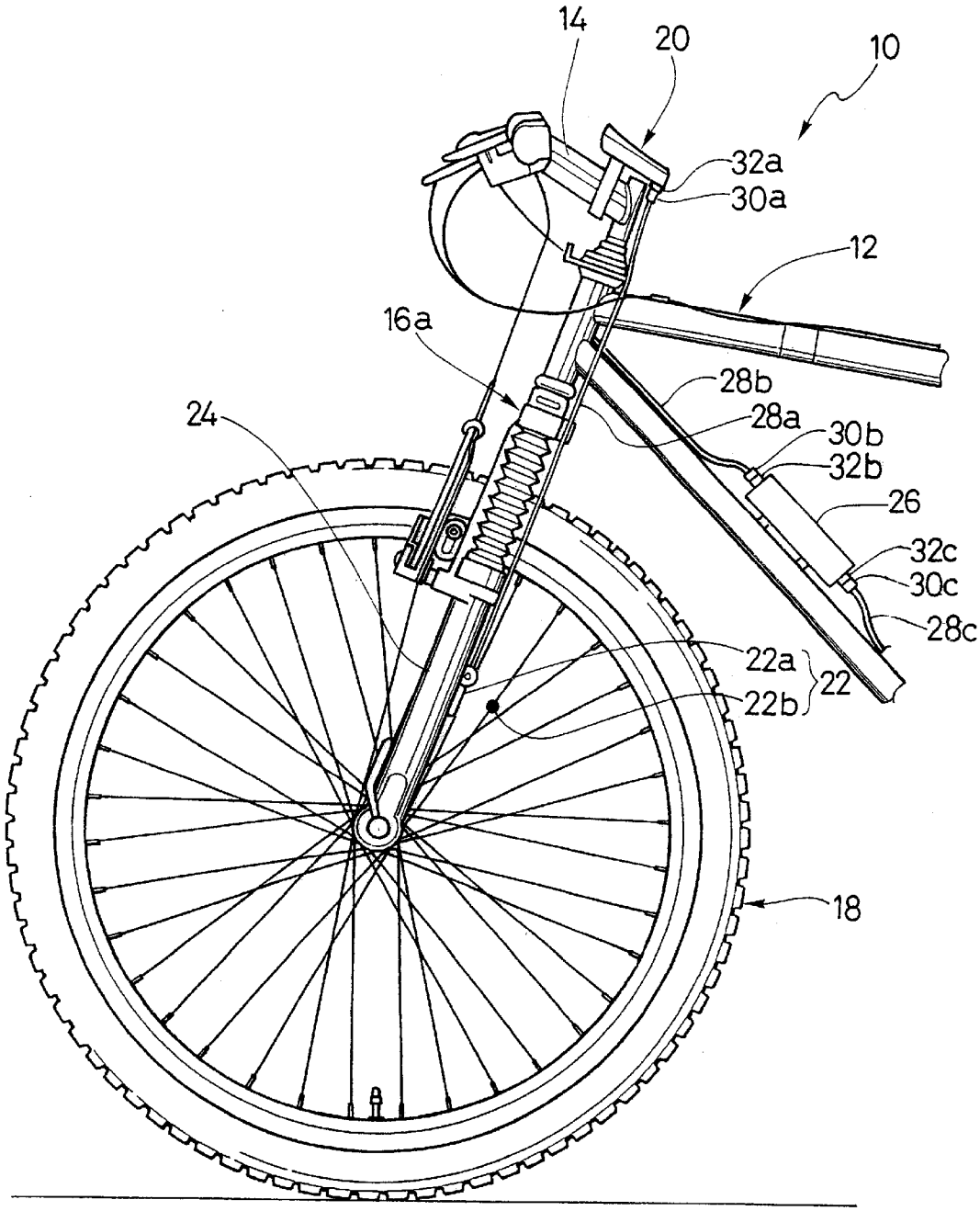
FIG. 1 is a partial, side elevational view of a bicycle with a bicycle computer, an electronically controlled front suspension and a front wheel sensor that utilize a bicycle electrical connector cord in accordance with a preferred embodiment of the present invention.
Figure 2:
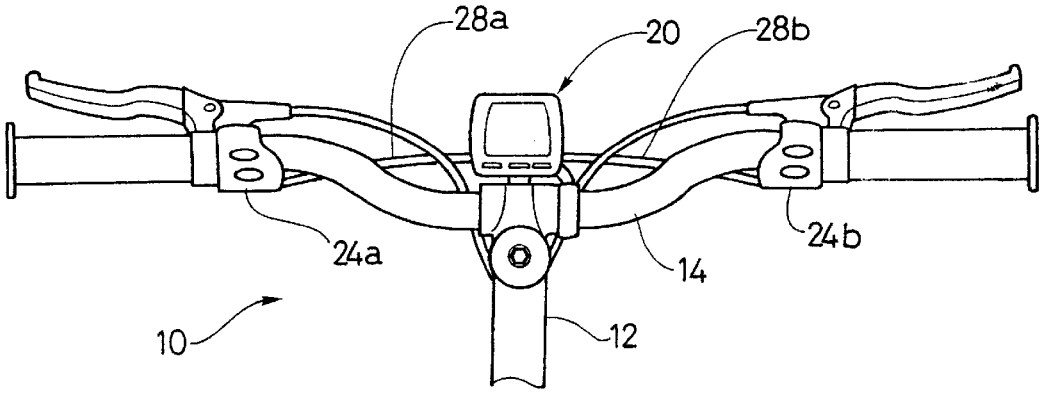
FIG. 2 is a top plan view of the handlebar portion of the bicycle with a cycle compute or control unit and a pair of shifting devices coupled thereto.

Referring initially to FIGS. 1 and 2, a front portion of an electronically controlled bicycle 10 is illustrated to explain the present invention. The present invention relates to the electrical connections between the electronically controlled components of the bicycle 10. Therefore, the bicycle 10 and its various components are well known in the prior art, except for the electrical connection between the electronically controlled components. Thus, the bicycle 10 and its various components will not be discussed or illustrated in detail herein, except for the components that relate to the present invention. Moreover, various conventional bicycle parts such as brakes, or drive trains, etc., which are not illustrated and/or discussed in detail herein, can be used in conjunction with the present invention. Furthermore, it will be apparent to those skilled in the art that the bicycle electrical cord 28 could be utilized to connect various other electrical devices of the bicycle 10 as needed and/or desired.

Basically, the bicycle 10 has a frame 12, a handlebar 14, an electronically controlled front suspension 16*a* coupled to the handlebar 14 and a front wheel 18 coupled to the electronically controlled front suspension 16*a*. The bicycle 10 also includes a cycle computer 20, a front wheel sensor 22, a pair of electronic shifting devices 24*a* and 24*b* and a junction box or connection unit 26. The bicycle 10 is also preferably equipped with an electronically controlled drive train (not shown) that is operated by the electronic shifting devices 24*a* and 24*b*. Moreover, the bicycle 10 can have an electronically controlled rear suspension 16*b*, which is only diagrammatically shown in FIG. 3.

Figure 3:
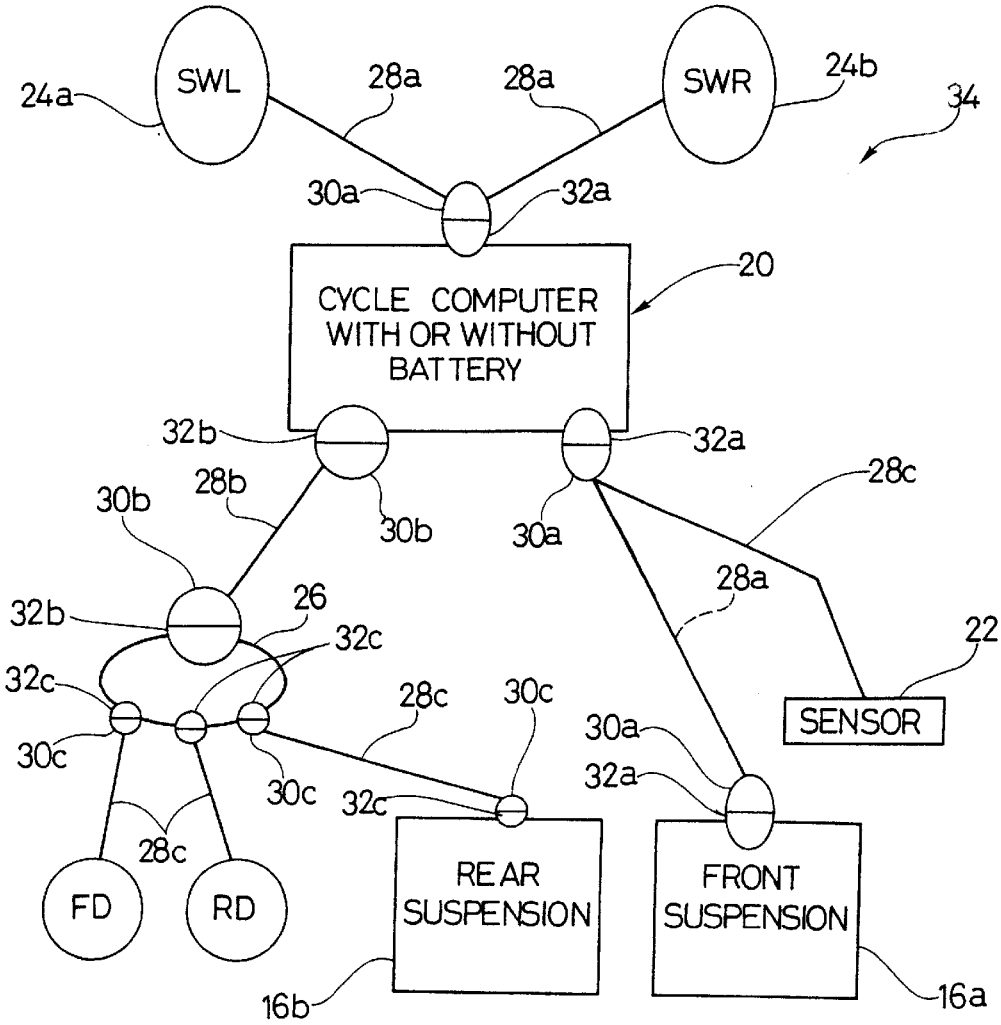
FIG. 3 is a diagrammatic illustration of the control system that uses electrical connectors of the present invention.
Figure 4:
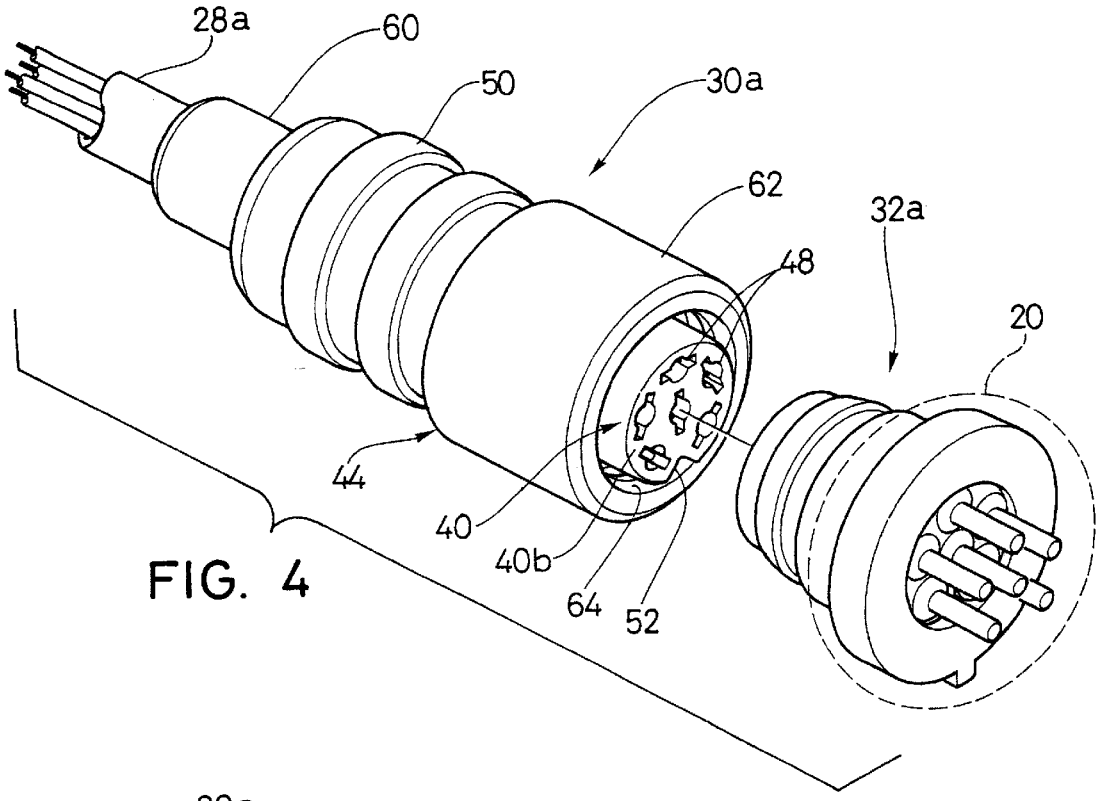
FIG. 4 is a perspective view of the male electrical connector coupled to an electrical device and the female electrical connector of the present invention, prior to being coupled together.
Figure 5:
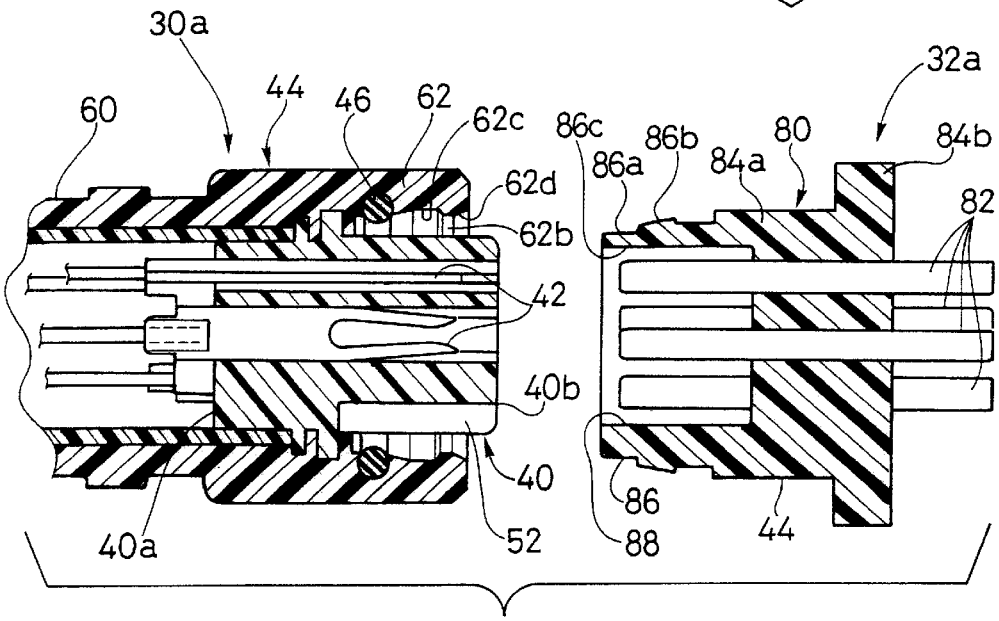
FIG. 5 is a longitudinal cross-sectional view of the female and male electrical connectors a taken along section 5—5 of FIG. 4.
Figure 6:
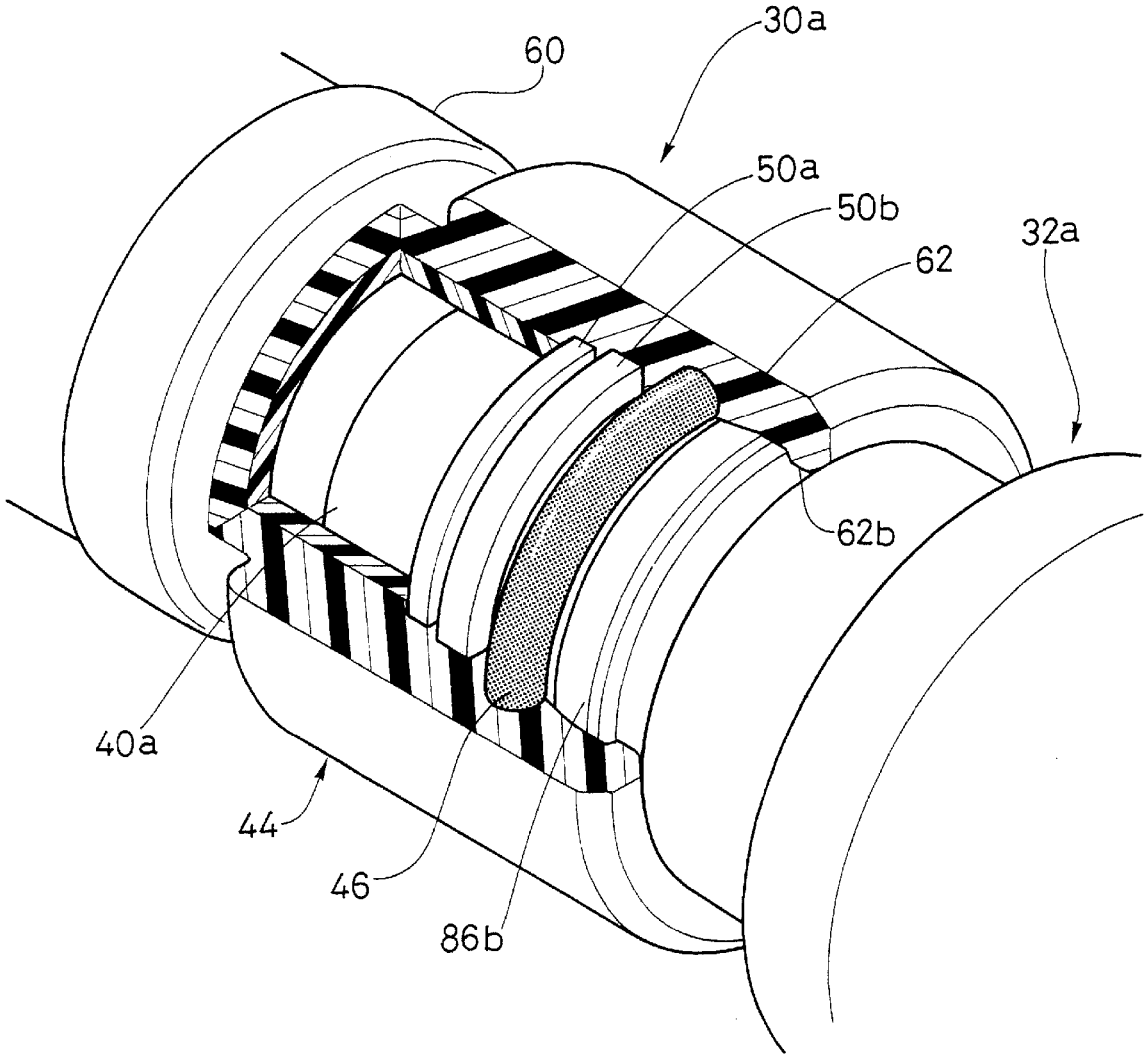
FIG. 6 is an enlarged partial perspective view of the female and male electrical connectors coupled together with selected portions broken away for illustration.
Figure 7:
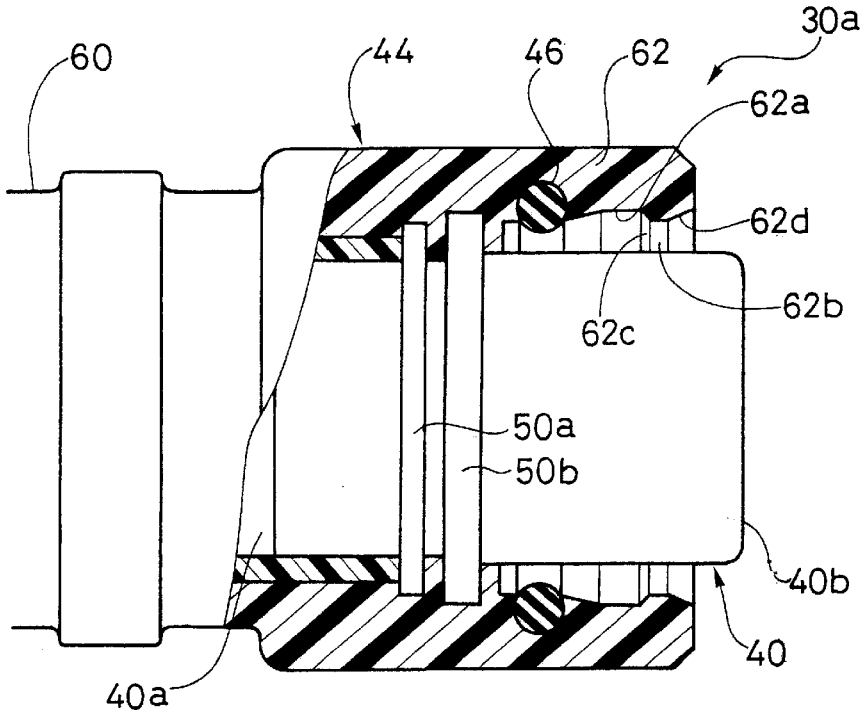
FIG. 7 is a side elevational view of the female electrical connector illustrated in FIGS. 4–6 with selected portions broken away for illustration.
Figure 8:
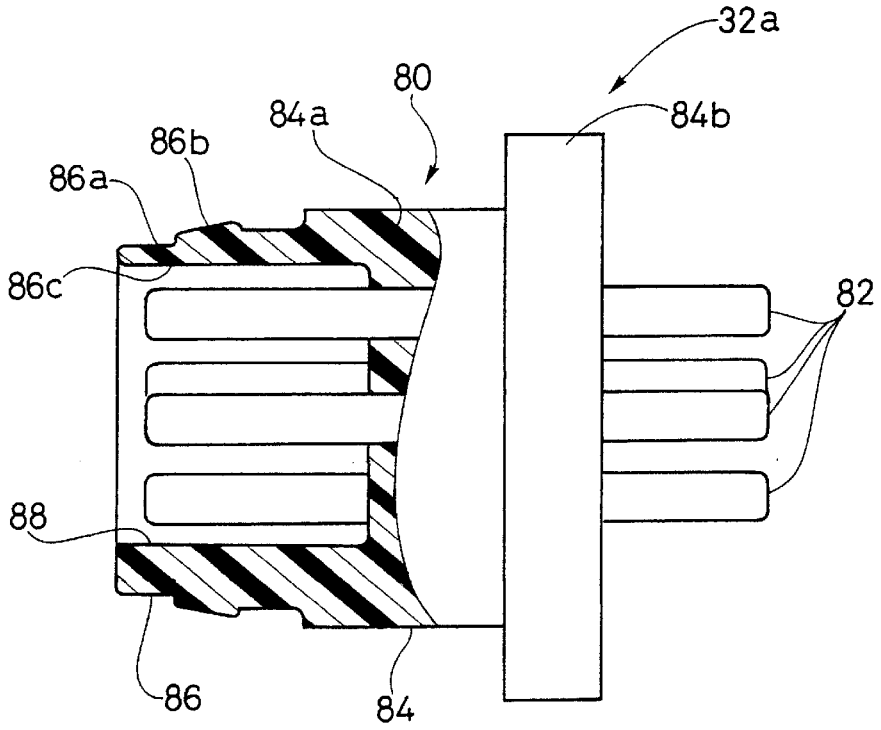
FIG. 8 is a side elevational view of the male electrical connector illustrated in FIGS. 4–6 with selected portions broken away for illustration.

The various electrical devices (the cycle computer 20, the electronically controlled front suspension 16*a*, the electronically controlled rear suspension 16*b*, the electronic shifting devices 24*a* and 24*b*, the junction box 26, etc.) of the bicycle 10 are electrically coupled together by multi-conductor electrical cords 28*a*, 28*b* or 28*c* in accordance with a preferred embodiment of the present invention. In particular, the electrical connector cords 28*a*, 28*b* or 28*c* are provided with at least one female electrical connector 30*a*, 30*b* or 30*c* located at one of its ends. As seen in FIG. 3, the female electrical connectors 30*a*, 30*b* and 30*c* plug into mating male electrical connectors 32*a*, 32*b* and 32*c*, which are provided in the cycle computer 20, the electronically controlled front suspension 16*a*, the electronically controlled rear suspension 16*b* and the junction box 26. Also, the sensor 22 is preferably electrically coupled to in the cycle computer 20 using the female electrical connector 30*a* that is connected to the electrical cord 28*a* of the electronically controlled front suspension 16*a*. Thus, the various electrical devices (the cycle computer 20, the electronically controlled front suspension 16*a*, the electronically controlled rear suspension 16*b*, the sensor 22, the electronic shifting devices 24*a* and 24*b*, the junction box 26, etc.) of the bicycle 10 form an electronic control system 34.

As illustrated in FIG. 3, the electronic control system 34 is utilized to control the front and rear suspensions and the drive train as well as other components of the bicycle 10, which are not shown. In the illustrated embodiment of FIG. 3, the electrical cords 28*a* are six-line cords in which all or some of the lines or conductors are utilized as needed. The electrical control cord 28 is a fifteen-line cord with all or some of the lines or conductors being utilized as needed. The electrical control cord 28*c* for the rear suspension is preferably a two-line cord. In this illustrated embodiment, the electrical connectors 30*a* and 32*b* are six-pin electrical connectors with only some or all of the pins being utilized. The electrical connectors 30*b* and 32*b* are fifteen-pin electrical connectors with only some or all of the pins being utilized. The electrical connectors 30*c* and 32*c* are two-pin electrical connectors. Of course, it will be apparent to those skilled in the art from this disclosure that these connectors 30*a*–30*c* and 32*a*–32*c* can be utilized with other bicycle components and in other types of arrangements as needed and/or desired. The electrical connectors 30*a*–30*c* are all substantially identical, except for their sizes, i.e., number of electrical contacts or terminal pins. Similar, the electrical connectors 32*a*–32*b* are all substantially identical, except for their sizes, i.e., number of electrical contacts or terminal pins. Accordingly, only the electrical connectors 30*a* and 32*a* will be discussed and illustrated in detail herein.

The cycle computer 20 preferably includes a microcomputer formed on a printed circuit board that is powered by a battery unit. The microcomputer of the cycle computer 20 includes a central processing unit (CPU), a random access memory component (RAM), a read only memory component (ROM), and an I/O interface. The various components of the microcomputer are well known in the bicycle field. Therefore, the components used in the microcomputer of the cycle computer 20 will not be discussed or illustrated in detail herein. Moreover, it will be apparent to those skilled in the art from this disclosure that the cycle computer 20 can include various electronic components, circuitry and mechanical components to carryout the present invention. Of course, it will be apparent to those skilled in the art from this disclosure that the cycle computer 20 can have a variety of configurations, as needed and/or desired. Thus, the cycle computer 20 functions as a shift control unit and a suspension control unit in the illustrated embodiment.

Preferably, the cycle computer 20 provides or displays various information to the rider via a display and operates the electronically controlled suspensions 16*a* and 16*b* and the electronically controlled shifting devices 24*a* and 24*b* based on input from the rider and/or input from the sensor 22. Thus, the front and rear suspensions 16*a* and 16*b* and the electronically controlled shifting devices 24*a* and 24*b* are operated or electronically controlled by the cycle computer 20.

The first or female electrical connector 30*a* basically has an electrical contact housing 40 with a plurality of first electrical contacts 42, an outer casing 44 molded on the electrical contact housing 40 and an annular sealing member 46 located between the electrical contact housing 40 and the outer casing 44. More specifically, first or female electrical connector 30*a* is a six-pin type female electrical connector and preferably includes six terminal pins 42. Of course, it will be apparent to those skilled in the art that the first electrical contacts 42 could utilize more or fewer terminal pins as needed and/or desired. In the illustrated embodiment, the first electrical connector 30*a* is designed to mate with one of male electrical connectors 32*a* of cycle computer 20.

The electrical contact housing 40 is constructed of an insulating material such as a hard, rigid plastic material. While the electrical contact housing 40 is illustrated as a female housing, it will be apparent to those skilled in the art from this disclosure that the electrical contact housing could be modified to be a male electrical contact housing without departing from the present invention. Basically, the electrical contact housing 40 has a first end 40a that is coupled to the free end of the electrical cord 28*a* and a second end 40*b* that mates with the corresponding male electrical connector 32*a*. The electrical contact housing 40 has a plurality of axial bores 48 extending between the first and second ends 40*a* and 40*b*. Each of these bores 48 has one of the electrical contacts 42 frictionally retained therein.

Between the first and second ends 40*a* and 40*b* are provided a pair of annular flanges or ribs 50*a* and 50*b* that assist in securing the outer casing 44 thereto. More specifically, the outer casing 44 is molded onto the electrical contact housing 40 such that the outer casing 44 surrounds the annular flanges 50*a* and 50*b*. Thus, axial movement between the electrical contact housing 40 and the outer casing 44 is prevented. Moreover, a watertight seal is formed between the electrical contact housing 40 and the outer casing 44 at these flanges 50*a* and 50*b*.

The electrical contacts 42 are conventional contacts constructed of an electrically conductive material. Each contact 42 is coupled to the electrical conductors of the electrical cord 28*a*. Preferably, the electrical conductors are soldered to the electrical contact.

The outer casing 44 is constructed of a relatively hard, rigid material that has limited flexibility and resiliency. For example, the outer casing 44 can be constructed of any suitable insulating material such as a hard, rigid plastic material. One example of a suitable material is a polyester blend. The outer casing 44 is generally a tubular member having an attachment portion 60 and a tubular portion 62.

The attachment portion 60 is fixedly coupled to the first end 40*a* of the electrical contact housing 40, while the tubular portion 62 is radially spaced from the second end 40*b* of the electrical contact housing 40 to form an annular space 64 between the inner surface 62*a* of the tubular portion 62 and the second end 40*b* of the electrical contact housing 40.

The tubular portion 62 of the outer casing 44 has an inwardly extending annular protrusion 62*b* that forms an annular detent. In other words, the annular protrusion 62*b* is an annular ring that mates with the corresponding electrical connector 32*b* to form a snap-fit therebetween as explained below. Accordingly, the material of the outer casing 44 should have limited resiliency such that a snap-fit connection can be formed between the pair of electrical connectors 30*a* and 32*a*, while providing a strong and firm connection that will not accidentally separate under normal use. In other words, the snap-fit connection between the electrical connectors 30*a* and 32*a* should be sufficiently strong such that they cannot be separated once coupled together during normal use. Accordingly, the annular protrusion 62*b* has an abutment surface 62*c* that faces away from the second end 40*b* of the electrical contact housing 40 for retaining the mating electrical connector 32*a* therein. The annular protrusion 62*b* also has an annular inclined surface 62*d* that serves as a ramp to aid in the insertion of the mating electrical connector 32*a*.

The annular sealing member 46 is preferably molded within the outer casing 44 such that the annular sealing member 46 cannot be accidentally removed. More specifically, the annular sealing member 46 is an O-ring with more than half of the diameter of the O-ring being embedded within the outer casing 44. The annular sealing member 46 is preferably formed of an elastomeric material such as an acrylonitrile-butadiene rubber (NBR) or any other suitable resilient and compressible material that can be utilized to carry out the present invention. In this embodiment, the annular sealing member 46 extends in a radial direction from the inner surface 62*a* of the tubular portion 62 of the outer casing 44. Thus, the annular sealing member 46 is compressed in a radial direction by the mating electrical connector 32*a* as explained below.

The electrical contact housing 40 also has an axially extending slot 52 on its exterior surface that acts as a polarizing slot to ensure correct orientation between the electrical connectors 30*a* and 32*a* as explained below. The outer casing 44 is preferably formed as a one-piece, unitary member that is integrally molded about the electrical contact housing 40 and the annular sealing member 46. Alternatively, the outer casing 44 can be constructed of two pieces (a non-compressible material and a compressible material) such that the annular sealing member 46 is formed as part of one of the pieces of the outer casing 44 as discussed below in one of the alternate embodiments.

The male electrical connector 32*a* preferably has an electrical contact housing or terminal housing 80 that is molded about a plurality of electrical contacts or terminal pins 82. The male electrical connector 32*a* is designed to mate with the female electrical connector 30*a* via a snap-fit. More specifically, the electrical contact housing 80 of the male electrical connector 32*a* is formed as a one-piece, unitary member that is molded utilizing the mold assembly 90 illustrated in FIGS. 9–17. The electrical contact housing 80 of the male electrical connector 32*a* basically includes a body portion 84 and a tubular portion 86. The body portion 84 has a main section 84*a* that is molded around the terminal pins 82 such that the terminal pins 82 are fixedly retained to the body portion 84 of the electrical contact housing 80. The body portion 84 also has an annular flange 84*b* extending radially outwardly from the main section 84*a*. This annular flange 84*b* can be utilized to mount the electrical connector 32*a* to the cycle computer 20 or one of the other electrical devices.

The tubular portion 86 is a cylindrically shaped member that extends axially from the main section 84*a* of the body portion 84, and is designed to form a snap-fit with the female electrical connector 30*a*. Accordingly, the tubular portion 86 has a cylindrical outer surface 86*a* with an annular protrusion 86*b*. The inner surface 86*c* of the tubular portion 86 is cylindrical and spaced from the free ends of the terminal pins 82. The electrical contact housing 80 is preferably constructed of a hard, rigid insulating material such as a hard, rigid plastic material. For example, the electrical contact housing of the male electrical connector can be constructed of a polyester blend material.

Figure 9:
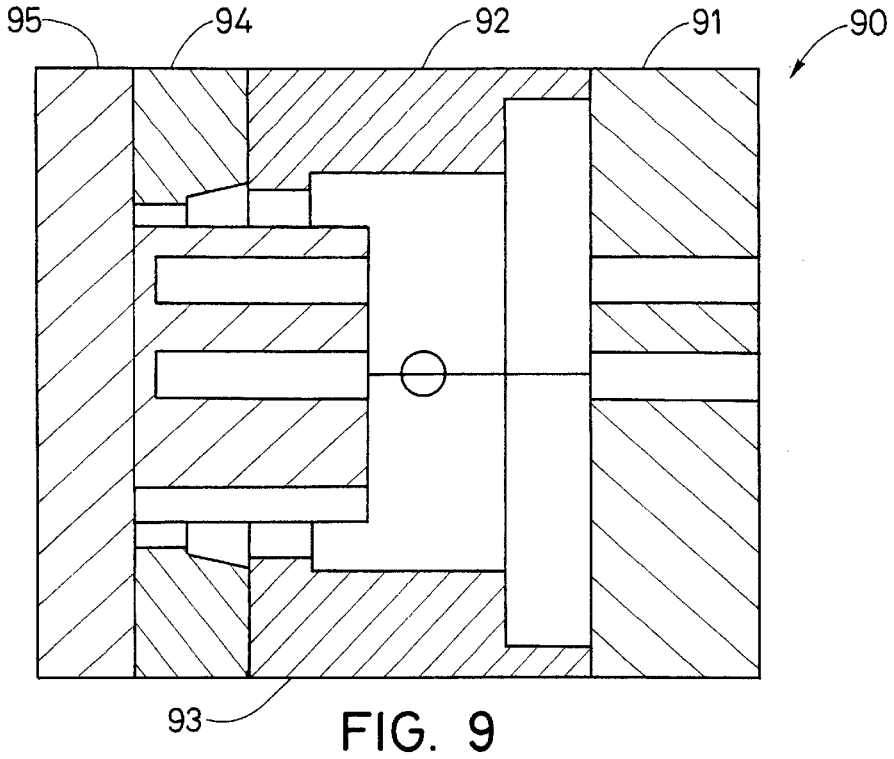
FIG. 9 is a longitudinal cross-sectional view of a mold assembly for manufacturing the male electrical connector illustrated in FIGS. 4–6 in accordance with the present invention.
Figure 10:
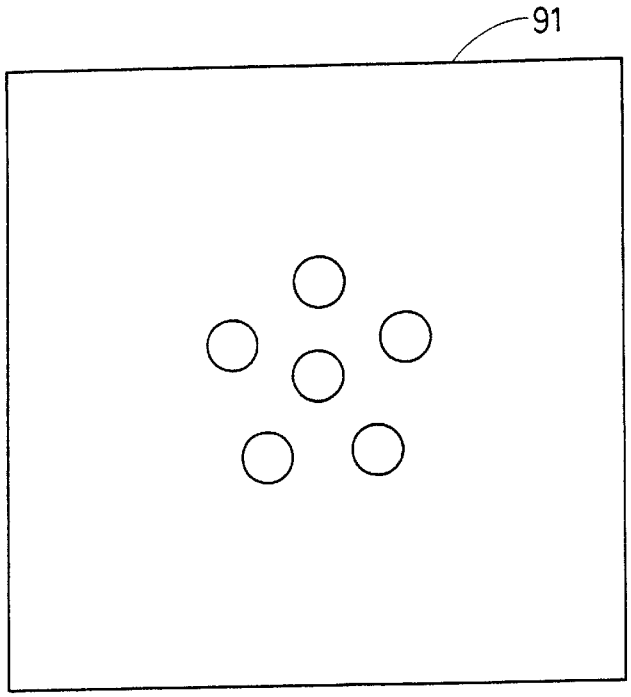
FIG. 10 is an end elevational view of a first mold part of the mold assembly illustrated in FIG. 9.
Figure 11:
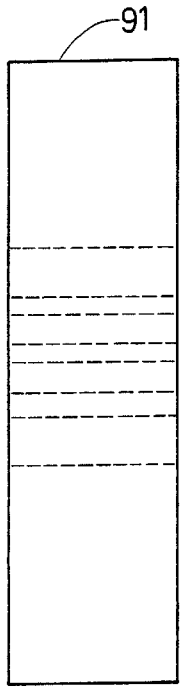
FIG. 11 is a side elevational view of the first mold part illustrated in FIG. 10 for the mold assembly illustrated in FIG. 9.
Figure 12:
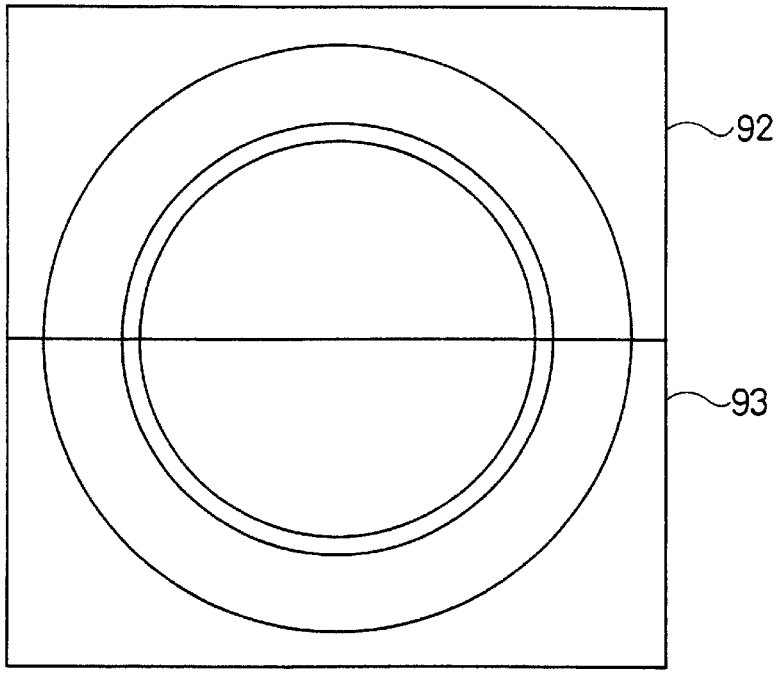
FIG. 12 is an end elevational view of a second mold part of the mold assembly illustrated in FIG. 9.
Figure 13:
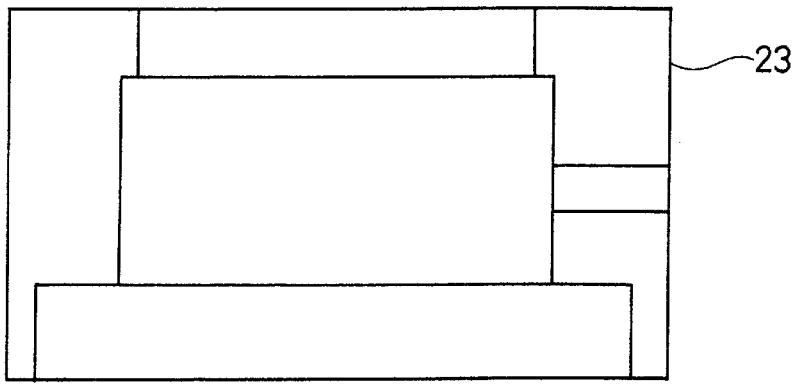
FIG. 13 is a top plan view of the bottom half of the second mold part illustrate in FIG. 12 for the mold assembly illustrated in FIG. 9.
Figure 14:
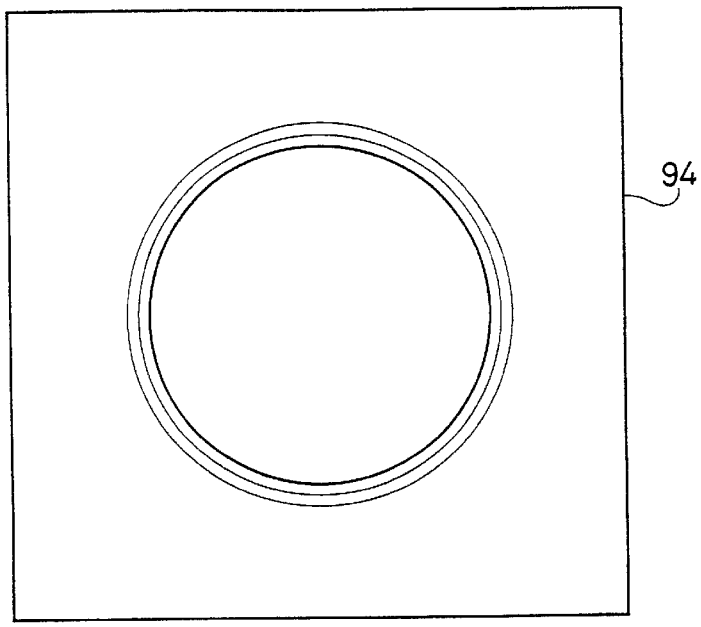
FIG. 14 is an end elevational view of a third mold part of the mold assembly illustrated in FIG. 9.
Figure 15:
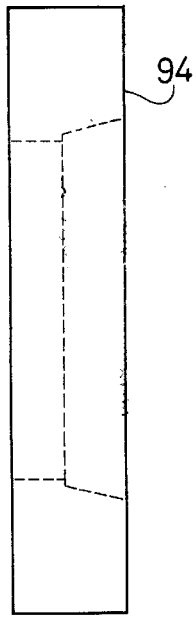
FIG. 15 is a side elevational view of the third mold part illustrated in FIG. 14 for the mold assembly illustrated in FIG. 9.
Figure 16:
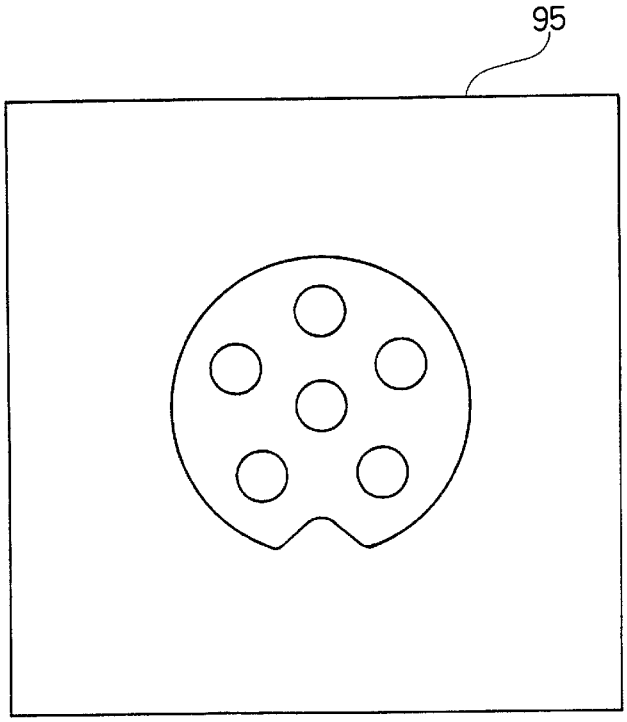
FIG. 16 is an end elevational view of a fourth mold part of the mold assembly illustrated in FIG. 9.
Figure 17:
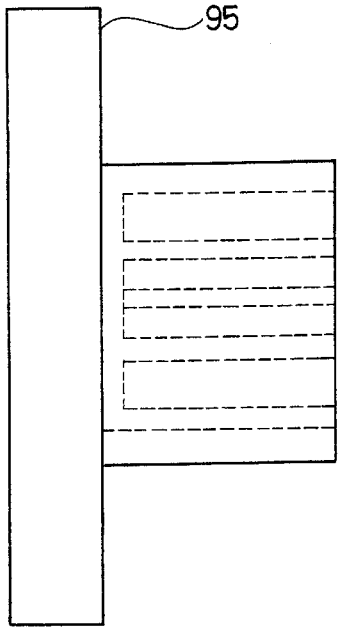
FIG. 17 is a side elevational view of the fourth mold part illustrated in FIG. 16 for the mold assembly illustrated in FIG. 9.

In forming the male electrical connector 32*a*, the molding parts 91–95 of the mold assembly 90 illustrated in FIGS. 9–17 are utilized. The male electrical connector 32*a* of cycle computer 20 basically includes an electrical contact housing 80 with six (or fewer) terminal pins or second electrical contacts 82. The receptor pins have a circular cross-section and are arranged in a pattern to mate with first electrical connector 30. The receptor housing preferably has an annular flange for releasably retaining the electrical connector 30 thereto via a snap-fit. The receptor housing is constructed of a non-conductive material such as a hard, rigid plastic material. The receptor pins are constructed of a conductive material. More specifically, a first molding part or member 91 supports one end of the terminal pins 82 and forms the axially facing surface of the annular flange 84*b* that faces away from the tubular portion 86. The body portion 84 of the electrical contact housing 80 is constructed of two mold parts or members 92 and 93 that are identical to each other. The tubular portion 86 is also formed of two mold parts or members 94 and 95 with the center part 94 supporting the free ends of the terminal pins 82 and forming the cylindrical inner surface 86*c* of the tubular portion 86. The other mold member or part 95 is a one-piece mold portion that forms the cylindrical outer surface 86*a* of the tubular portion 86 that includes the annular protrusion 86*b*. Accordingly, a very smooth and round cylindrical outer surface 86*a* is formed. When the mold parts 9195 of the mold assembly 90 are assembled as shown in FIG. 9, the material of the electrical contact housing 80 is injected into the mold assembly 90 to form the electrical contact housing 80 with the terminal pins 82 secured therein.

The female electrical connector 30*a* is coupled to the male electrical connector 32*a* by applying an axial force between the female and male electrical connectors 30*a* and 32*a* to create a snap-fit therebetween. More specifically, the female electrical connector 30*a* is oriented such that the polarizing slot 52 of the electrical contact housing 40 of the female electrical connector 30*a* aligns with the polarizing rib 88 of the electrical contact housing 80 of the male electrical connector 32*a*. Once the polarizing slot 52 and the polarizing rib 88 are aligned, the female electrical connector 30*a* is moved axially such that the terminal pins 82 enter the bores of the electrical contact housing 40 of the female electrical connector 30*a* to electrically engage the electrical contacts 42. The tubular portion 86 of the male electrical connector 32*a* is received in the annular space between the electrical contact housing 40 and the outer casing 44. The tubular portion 86 is continued to be moved axially within the annular space of the female electrical connector 30*a* until the annular protrusion 86*b* of the male electrical connector 32*a* passed beneath the annular protrusion 62*b* of the outer casing 44. Thus the abutment surfaces of the annular protrusions 62*b* and 86*b* contact each other to prevent axial separation of the female and male electrical connectors 30*a* and 32*a*. Moreover, the annular sealing member 46 is compressed by the tubular portion 86 of the male electrical connector 32*a* to form a watertight connection therebetween.

Referring back to FIG. 1, the sensor 22 is preferably a front wheel speed sensing unit that includes a sensing portion 22*a* and a magnet 22*b*. The sensing portion 22*a* is preferably a magnetically operable sensor that is mounted on the front suspension 16*a* of the bicycle 10 and senses the magnet 22*b* that is attached to one of the spokes of the front wheel 18 of the bicycle 10. In the illustrated embodiment, the sensing portion 22*a* includes a reed switch for detecting the magnet 22*b*. The sensor 22 generates a pulse each time wheel 18 of the bicycle 10 has turned a prescribed angle or rotation. The sensor 22 outputs a bicycle speed signal to the computer 20 by detecting magnet 22*b* mounted on front wheel 18 of the bicycle 10. In other words, the sensor 22 detects the rotational velocity of the front wheel 18 of the bicycle 10.

Referring to FIG. 3, the front and rear suspensions 16*a* and 16*b* are not critical to the present invention. There are currently numerous types of adjustable suspensions for the bicycle 10 that can be utilized to carry out the present invention. Preferably, the front and rear suspensions 16*a* and 16*b* utilize two conventional air shocks with hydraulic dampening mechanisms that have been modified to carry out the present invention. An electric motor is electrically coupled to the cycle computer 20 that selectively operates the electrical motor to adjust the stiffness of the front and rear suspensions 16*a* and 16*b*.

In the manual mode, shifting of each of the motorized derailleurs FD and RD (diagrammatically shown in FIG. 3) is performed by via manual shifting devices or shifting devices 24*a* and 24*b*. While the shifting devices 24*a* and 24*b* illustrated herein utilizes down and up shift buttons, it will be apparent to those skilled in the art from this disclosure that various other types of shift devices can used, such as levers, without departing from the scope of the invention as defined in the appended claims. Depressing one of the shift buttons of the shifting devices 24*a* and 24*b* generates a predetermined operational command that is received by the central processing unit of the cycle computer 20. The central processing unit of the cycle computer 20 then sends a predetermined operational command or electrical signal to move or shifting one of the motorized derailleurs FD and RD.

In the automatic mode, shifting of each of the motorized derailleurs FD and RD is preferably at least partially based on the speed of the bicycle 10. Thus, the cycle computer 20 further includes at least one sensing/measuring device or component that provides information indicative of the speed of the bicycle 10 to its central processing unit of the cycle computer 20. In the illustrated embodiment, the sensor 22 generates a predetermined operational command indicative of the speed of the bicycle 10. Of course, additional sensing/measuring components can be operatively coupled to central processing unit of the cycle computer 20 such that predetermined operational commands are received by the central processing unit (CPU) to operate the motorized derailleurs FD and RD or other components.

The junction box 26 preferably includes a single power input or electrical control cords 28*b* for receiving signals from the shifting device 24*a* and 24*b* and three power outputs or electrical control cords 28*c* for sending signals to the rear and front motorized derailleur FD and RD and the rear suspension 16*b*. The power input operatively couples the cycle computer 20 to the junction box 26.

SECOND EMBODIMENT

Figure 18:
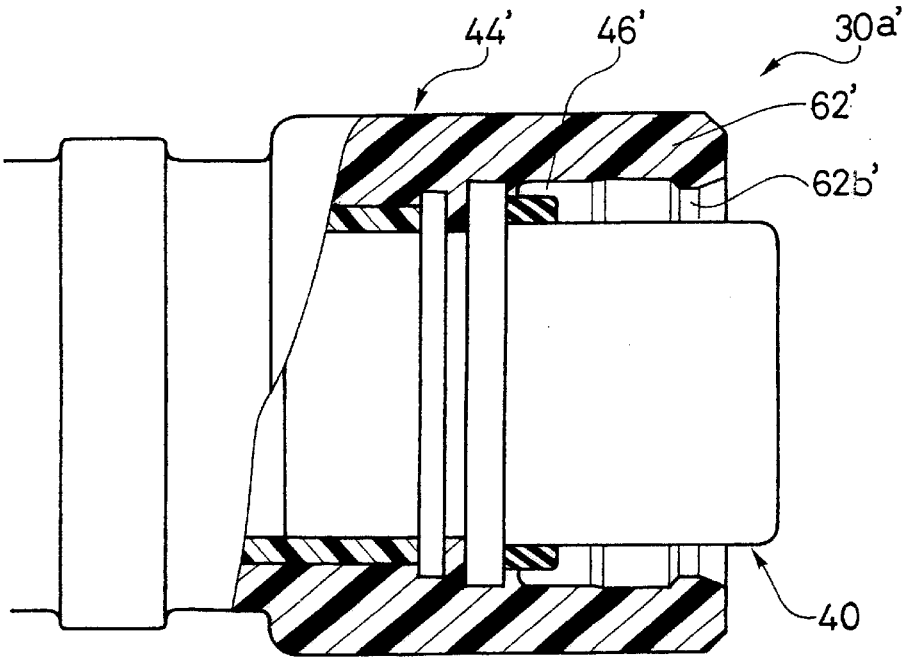
FIG. 18 is a side elevational view of a modified female electrical connector with selected portions broken away for illustration in accordance with a second embodiment of the present invention.

Referring now to FIG. 18, a female electrical connector 30*a*' is illustrated in accordance with a second embodiment of the present invention. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a prime (').

The female electrical connector 30*a*' basically has an electrical contact housing 40 with a plurality of first electrical contacts (not shown), an outer casing 44' molded on the electrical contact housing 40 and an annular sealing member 46' located between the electrical contact housing 40 and the outer casing 44'. Preferably, the female electrical connector 30*a*' is a six-pin type female electrical connector. Of course, it will be apparent to those skilled in the art that more or fewer terminal pins can be utilized as needed and/or desired. In the illustrated embodiment, the electrical connector 30*a*' is designed to mate with the male electrical connectors 32*a*, discussed above.

In this embodiment, the annular sealing member 46' has been modified to form a tubular member that engages the external cylindrical surface of the electrical contact housing 40 with the outer casing 44' being molded about one end of the annular sealing member 46'. Accordingly, the outer cylindrical surface of the annular sealing member 46' in this embodiment is radially spaced from the cylindrical inner surface of the tubular portion 62' of the outer casing 44'. Accordingly, the free end of the tubular portion 86 of the male electrical connector 32*a* can be positioned between the inner cylindrical surface of the tubular portion 62' of the outer casing 44' and the annular sealing member 46'. In other words, the tubular portion 62' of the male electrical connector 32*a* compresses the annular sealing member 46' radially inwardly to form a watertight connection between the interfaces of the surfaces of the annular sealing member 46' and the inner cylindrical surface of the tubular portion 62' of the male electrical connector 32*a*.

THIRD EMBODIMENT.

Figure 19:
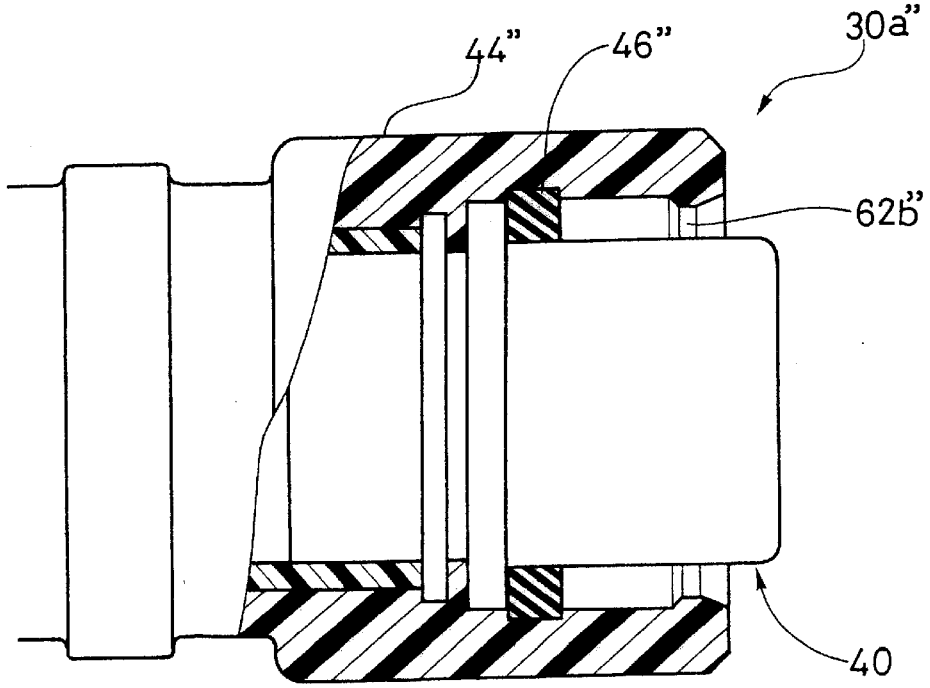
FIG. 19 is a side elevational view of a modified female electrical connector with selected portions broken away for illustration in accordance with a third embodiment of the present invention.

Referring now to FIG. 19, a female electrical connector 30*a*" is illustrated in accordance with a third embodiment of the present invention. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity. The parts of the third embodiment that differ from the parts of the first embodiment will be indicated with a double prime (").

The female electrical connector 30*a*" basically has an electrical contact housing 40 with a plurality of first electrical contacts (not shown), an outer casing 44" molded on the electrical contact housing 40 and an annular sealing member 46" located between the electrical, contact housing 40 and the outer casing 44". Preferably, the female electrical connector 30*a*" is a six-pin type female electrical connector. Of course, it will be apparent to those skilled in the art that more or fewer terminal pins can be utilized as needed and/or desired. In the illustrated embodiment, the electrical connector 30*a*" is designed to mate with the male electrical connectors 32*a*, discussed above.

In this embodiment, the annular sealing member 46" is an O-ring having a substantially rectangular or square cross-section that engages both the inner cylindrical surface of the tubular portion 62" of the outer casing 44" and the opposing cylindrical surface of the electrical contact housing 40. In other words, a watertight connection is formed between the electrical contact housing 40 and the outer casing 44" where they interface with the annular sealing member 46". Preferably in this embodiment, the annular sealing member 46" is partially embedded within the outer casing 44" during the molding process of the outer casing 44" such that the annular sealing member 46" is fixedly retained in the annular space between the electrical contact housing 40 and the outer casing 44".

When the male electrical connector 32*a* is mated with the female electrical connector 30*a*", the free end of the tubular portion 86 of the male electrical connector 32*a* axially compresses the annular sealing member 46" to create a watertight connection between the female and male electrical connectors 30*a*" and 32*a*.

FOURTH EMBODIMENT

Figure 20:
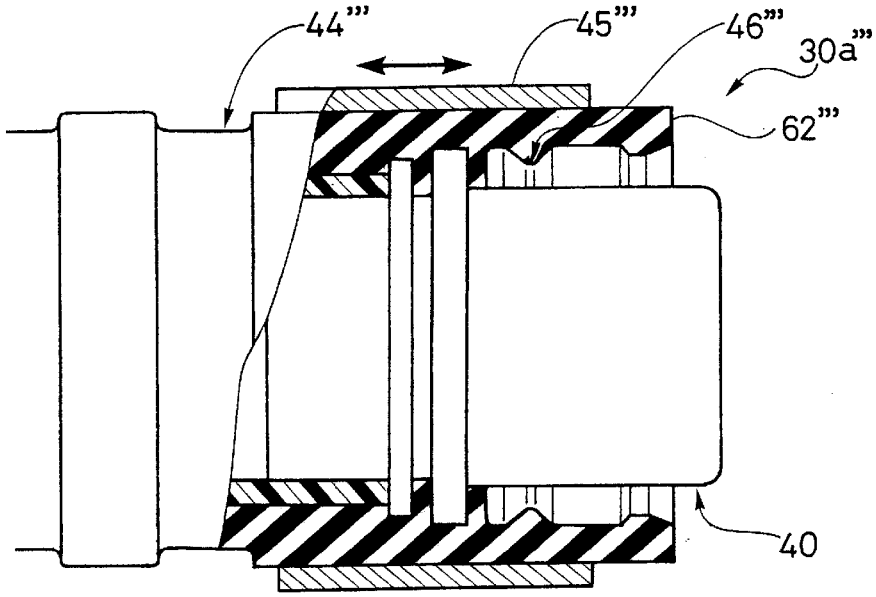
FIG. 20 is a side elevational view of a modified female electrical connector with selected portions broken away for illustration in accordance with a fourth embodiment of the present invention.

Referring now to FIG. 20, a female electrical connector 30*a*'" is illustrated in accordance with a fourth embodiment of the present invention. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity. The parts of the fourth embodiment that differ from the parts of the first embodiment will be indicated with a triple prime ("').

The female electrical connector 30*a*'" basically has an electrical contact housing 40 with a plurality of first electrical contacts (not shown) and an outer casing 44" molded on the electrical contact housing 40. The outer casing 44'" has an annular sealing member 46'" integrally formed therewith so as to be extend from the inner surface of the outer casing 44'" towards the electrical contact housing 40. Preferably, the female electrical connector 30*a*'" is a six-pin type female electrical connector. Of course, it will be apparent to those skilled in the art that more or fewer terminal pins can be utilized as needed and/or desired. In the illustrated embodiment, the electrical connector 30*a*'" is designed to mate with the male electrical connectors 32*a*, discussed above.

In this embodiment, the outer casing 44''' is constructed of two pieces. More specifically, the outer casing 44''' includes a rigid sleeve 45''' that overlies a resilient compressible member or inner tubular part 62'''. Preferably, the sleeve 45''' is constructed of a rigid, non-compressible material. For example, the sleeve 45''' can be constructed of metal or a very hard plastic material with relatively no flexibility or resiliency. In this embodiment, the annular sealing member 46''' is integrally formed with the compressible material of the inner part 62''' of the outer casing 44'''. Preferably, the inner tubular part 62''' is formed of an elastomeric material such as an acrylonitrile-butadiene rubber (SPBR) or any other suitable resilient and compressible material that can be utilized to carry out the present invention. More specifically, the inner cylindrical surface of the tubular part 62''' of the outer casing 44''' is attached at one end to the electrical cord 28*a*, and has an annular protrusion 62*b*''' that extends radially inwardly from the cylindrical inner surface of the other end of the tubular part 62'''. Thus, when the male electrical connector 32*a* is mated with the female electrical connector 30*a*''', the tubular portion 86 of the male electrical connector 32*a* will radially compress the annular sealing member 46''' in an outward direction to create a water tight seal therebetween. Also, when the female and male electrical connectors 30*a*''' and 32*a* are coupled together, the annular protrusions 62*b*''' and 86*b* of the female and male electrical connectors 30*a*''' and 32*a* will engage each other via a snap-fit. Since the inner tubular part 62''' of the outer casing 44''' is constructed of a compressible resilient material, the inner tubular part 62''' of the outer casing 44''' is to flexible to provide a strong connection between the mating annular protrusions 62*b*''' and 86*b*. The hard rigid sleeve 45''' overlies the inner tubular part 62''' of the outer casing 44''' to prevent radial outward movement of the inner tubular part 62''' of the outer casing 44'''. In other words, it is necessary to slide the sleeve 45''' over the mating annular protrusions 62*b*''' and 86*b* such that radial movement of the annular protrusion 62*b*''' of the inner part 62'''of the outer casing 44''' is prevented. Thus, under normal use, this snap-fit connection will prevent separation of the female and male electrical connectors 30*a*''' and 32*a*. Of course, the inner tubular part 62''' is sufficiently compressible such the female and male electrical connectors 30*a*''' and 32*a* will release, if a sufficiently high axial force is applied between the female and male electrical connectors 30*a*''' and 32*a*. For example, if the electrical cord 28*a* gets caught on a branch or another obstruction, this snap-fit connection will separate the female and male electrical connectors 30*a*''' and 32*a* to avoid serious damage to the electrical cord 28*a* and to prevent the rider from losing control over the bicycle 10. More specifically, when the electrical cord 28*a* gets caught on a branch or another obstruction, the annular protrusion 62*b*''' of the inner tubular part 62''' will compress in a radial direction even though the sleeve 45''' overlies the inner tubular part 62'''. However, under normal riding conditions, this snap-fit connection will prevent separation of the female and male electrical connectors 30*a*''' and 32*a*.

FIFTH EMBODIMENT

Figure 21:
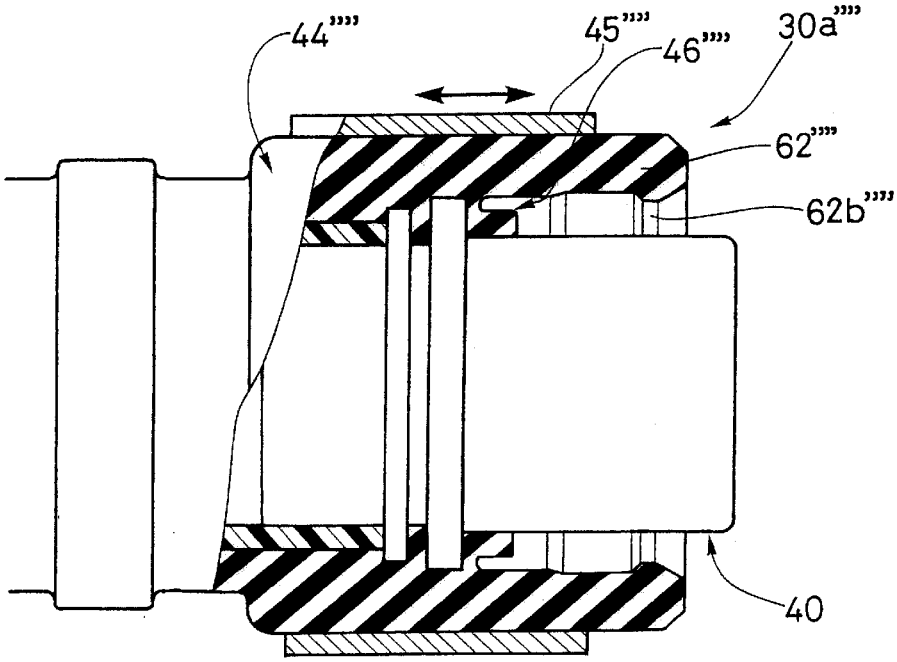
FIG. 21 is a side elevational view of a modified female electrical connector with selected portions broken away for illustration in accordance with a fifth embodiment of the present invention.

Referring now to FIG. 21, a female electrical connector 30*a*'''' is illustrated in accordance with a fifth embodiment of the present invention. In view of the similarity between the first and fifth embodiments, the parts of the fifth embodiment that are identical to the parts of the first embodiment will be given the same reference numerals as the parts of the first embodiment. Moreover, the descriptions of the parts of the fifth embodiment that are identical to the parts of the first embodiment may be omitted for the sake of brevity. The parts of the fifth embodiment that differ from the parts of the first embodiment will be indicated with four primes ("").

The female electrical connector 30*a*'''' basically has an electrical contact housing 40 with a plurality of first electrical contacts (not shown) and an outer casing 44'''' molded on the electrical contact housing 40. The outer casing 44'''' has an annular sealing member 46'''' integrally formed therewith so as to extend along a portion of the electrical contact housing 40 and form a space between the inner surface of the outer casing 44'''' and the opposed surface of the annular sealing member 46''''. Preferably, the female electrical connector 30*a*'''' is a six-pin type female electrical connector. Of course, it will be apparent to those skilled in the art that more or fewer terminal pins can be utilized as needed and/or desired. In the illustrated embodiment, the electrical connector 30*a*'''' is designed to mate with the male electrical connectors 32*a*, discussed above.

This fifth embodiment is also similar to the fourth embodiment, except that the annular sealing member 46'''' is constructed similar to the second embodiment such that the annular sealing member 46'''' is compressed radially inwardly by the tubular portion 86 of the male electrical connector 32*a* during the coupling of the female and male electrical connectors 30*a*'''' and 32*a*.

In this embodiment, the outer casing 44'''' is constructed of two pieces. More specifically, the outer casing 44'''' includes a rigid sleeve 45'''' that overlies a resilient compressible member or inner part 62'''. Preferably, the sleeve 45'''' is constructed of a rigid, non-compressible material. For example, the sleeve 45'''' can be constructed of metal or a very hard plastic material with relatively no flexibility or resiliency. In this embodiment, the annular sealing member 46'''' is integrally formed with the compressible material of the inner part 62'''' of the outer casing 44''''. Preferably, the inner tubular part 62'''' is formed of an elastomeric material such as an acrylonitrile-butadiene rubber (BR) or any other suitable resilient and compressible material that can be utilized to carry out the present invention. More specifically, the inner cylindrical surface of the tubular part 62'''' of the outer casing 44'''' is attached at one end to the electrical cord 28*a*, and has an annular protrusion 62*b*'''' that extends radially inwardly from the cylindrical inner surface of the other end of the tubular part 62''''. Thus, when the male electrical connector 32*a* is mated with the female electrical connector 30*a*'''', the tubular portion 86 of the male electrical connector 32*a* will radially compress the annular sealing member 46'''' in an inward direction to create a water tight seal therebetween. Also, when the female and male electrical connectors 30*a*'''' and 32*a* are coupled together, the annular protrusions 62*b*'''' and 86*b* of the female and male electrical connectors 30*a*'''' and 32*a* will engage each other via a snap-fit. Since the inner tubular part 62'''' of the outer casing 44'''' is constructed of a compressible resilient material, the inner tubular part 62'''' of the outer casing 44'''' is to flexible to provide a strong connection between the mating annular protrusions 62*b*'''' and 86*b*. The hard rigid sleeve 45'''' overlies the inner tubular part 62'''' of the outer casing 44'''' to prevent radial outward movement of the inner tubular part 62'''' of the outer casing 44''''. In other words, it is necessary to slide the sleeve 45'''' over the mating annular protrusions 62*b*'''' and 86*b* such that radial movement of the annular protrusion 62*b*'''' of the inner part 62'''' of the outer casing 44'''' is prevented. Thus, under normal use, this snap-fit connection will prevent separation of the female and male electrical connectors 30*a*'''' and 32*a*. Of course, the inner tubular part 62'''' is sufficiently compressible such the female and male electrical connectors 30*a*"" and 32*a* will release, if a sufficiently high axial force is applied between the female and male electrical connectors 30*a*"" and 32*a*. For example, if the electrical cord 28*a* gets caught on a branch or another obstruction, this snap-fit connection will separate the female and male electrical connectors 30*a*"" and 32*a* to avoid serious damage to the electrical cord 28*a* and to prevent the rider from losing control over the bicycle 10. More specifically, when the electrical cord 28*a* gets caught on a branch or another obstruction, the annular protrusion 62*b*"" of the inner tubular part 62"" will compress in a radial direction even though the sleeve 45"" overlies the inner tubular part 62"". However, under normal riding conditions, this snap-fit connection will prevent separation of the female and male electrical connectors 30*a*"" and 32*a*.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An electrical connector comprising:

an electrical contact housing having a first end and a second end with at least one bore extending between said first and second ends;

at least one electrical contact being retained within said bore of said electrical contact housing;

an outer casing including an attachment portion fixedly coupled to said first end of said electrical contact housing and a tubular portion radially spaced from said second end of said electrical contact housing to form an annular space between an inner surface of said tubular portion and said second end of said electrical contact housing, said tubular portion of said outer casing having an inwardly extending protrusion with an abutment surface that faces away from said second end of said electrical contact housing, said outer casing including at least a substantially rigid sleeve; and an annular sealing member formed of a resilient and compressible material that is located in said annular space and fixedly coupled to said tubular portion of said outer casing.

2. The electrical connector according to claim 1, wherein said annular sealing member is located axially inward from said abutment surface relative to said second end of said electrical contact housing.

3. The electrical connector according to claim 1, wherein said annular sealing member is partially embedded in said tubular portion of said outer casing.

4. An electrical connector comprising:

an electrical contact housing having a first end and a second end with at least one bore extending between said first and second ends;

at least one electrical contact being retained within said bore of said electrical contact housing;

an outer casing including an attachment portion fixedly coupled to said first end of said electrical contact housing and a tubular portion radially spaced from said second end of said electrical contact housing to form an annular space between an inner surface of said tubular portion and said second end of said electrical contact housing, said tubular portion of said outer casing having an inwardly extending protrusion with an abutment surface that faces away from said second end of said electrical contact housing; and an annular sealing member formed of a resilient and compressible material that is located in said annular space, said outer casing being molded about said annular sealing member to retain said annular sealing member in said tubular portion of said outer casing.

5. An electrical connector comprising:

an electrical contact housing having a first end and a second end with at least one bore extending between said first and second ends;

at least one electrical contact being retained within said bore of said electrical contact housing;

an outer casing including an attachment portion fixedly coupled to said first end of said electrical contact housing and a tubular portion radially spaced from said second end of said electrical contact housing to form an annular space between an inner surface of said tubular portion and said second end of said electrical contact housing, said tubular portion of said outer casing having an inwardly extending protrusion with an abutment surface that faces away from said second end of said electrical contact housing; and an annular sealing member formed of a resilient and compressible material that is located in said annular space, said annular sealing member being an O-ring having at least half embedded in said tubular portion of said outer casing.

6. The electrical connector according to claim 5, wherein said annular sealing member is formed of an acrylonitrile-butadiene rubber.

7. The electrical connector according to claim 1, wherein said annular sealing member is formed of an elastomeric material.

8. The electrical connector according to claim 7, wherein said elastomeric material of said annular sealing member is an acrylonitrile-butadiene rubber.

9. An electrical connector according to claim 7, wherein said tubular portion of said outer casing is constructed of a non-compressible material.

10. An electrical connector comprising:

an electrical contact housing having a first end and a second end with at least one bore extending between said first and second ends;

at least one electrical contact being retained within said bore of said electrical contact housing;

an outer casing including an attachment portion fixedly coupled to said first end of said electrical contact housing and a tubular portion radially spaced from said second end of said electrical contact housing to form an annular space between an inner surface of said tubular portion and said second end of said electrical contact housing, said tubular portion of said outer casing having an inwardly extending protrusion with an abutment surface that faces away from said second end of said electrical contact housing; and an annular sealing member formed of a resilient and compressible material that is located in said annular space, said annular sealing member contacting said inner surface of said tubular portion of said outer casing and an opposed surface of said electrical contact housing.

11. The electrical connector according to claim 10, wherein said annular sealing member is formed of an elastomeric material, and said tubular portion of said outer casing is constructed of a non-compressible material.

12. The electrical connector according to claim 11, wherein said elastomeric material of said annular sealing member is an acrylonitrile-butadiene rubber.

13. An electrical connector according to claim 11, wherein said annular sealing member is an O-ring having at partially embedded in said tubular portion of said outer casing.

14. The electrical connector according to claim 1, wherein said attachment portion and said tubular portion being formed as a one-piece, unitary member.

15. The electrical connector according to claim 1, wherein said tubular portion of said outer casing includes an inner part formed of a resilient and compressible material and a substantially rigid sleeve slideably overlying said inner part, said inner part includes said inner surface of said tubular portion of said outer casing.

16. An electrical connector comprising:

an electrical contact housing having a first end and a second end with at least one bore extending between said first and second ends;

at least one electrical contact being retained within said bore of said electrical contact housing;

an outer casing including an attachment portion fixedly coupled to said first end of said electrical contact housing and a tubular portion radially spaced from said second end of said electrical contact housing to form an annular space between an inner surface of said tubular portion and said second end of said electrical contact housing, said tubular portion of said outer casing having an inwardly extending protrusion with an abutment surface that faces away from said second end of said electrical contact housing, said tubular portion of said outer casing including an inner part formed of a resilient and compressible material and a substantially rigid sleeve slideably overlying said inner part, said inner part including said inner surface of said tubular portion of said outer casing; and an annular sealing member formed of a resilient and compressible material that is located in said annular space, said annular sealing member and said inner part being formed as a one-piece, unitary member.

17. The electrical connector according to claim 16, wherein said annular sealing member extends inwardly in a radial direction from said inner surface of said tubular portion of said outer casing.

18. The electrical connector according to claim 16, wherein said annular sealing member contacts said electrical contact housing and is spaced from said inner surface of said tubular portion.

19. An electrical connector assembly comprising:

a first electrical connector including a first electrical contact housing having a first end and a second end with at least one bore extending between said first and second ends and;

at least one first electrical contact being retained within said bore of said first electrical contact housing;

an outer casing including an attachment portion fixedly coupled to said first end of said first electrical contact housing and a first tubular portion radially spaced from said second end of said first electrical contact housing to form an annular space between an inner surface of said first tubular portion and said second end of said first electrical contact housing, said tubular portion of said outer casing having an inwardly extending first annular protrusion with an axial abutment surface that faces away from said second end of said first electrical contact housing, said outer casing including at least a substantially rigid sleeve; and an annular sealing member formed of a resilient and compressible material that is located in said annular space and fixedly coupled to said first tubular portion of said outer casing; and a second electrical connector including a second electrical contact housing having a body portion and a second tubular portion having a cylindrical outer surface with a second annular protrusion, said second tubular portion being dimensioned to be received within said annular space of said first electrical connector such that said first and second annular protrusions engage each other to form a snap fit connection therebetween and such that said annular sealing member is compressed by said second tubular portion; and at least one second electrical contact being retained within said body portion of said second electrical contact housing such that said second electrical contact mates with said first electrical contact when said first and second electrical contact housings are coupled together.

* * * * *